US006753491B1

(12) United States Patent
Huang

(10) Patent No.: US 6,753,491 B1
(45) Date of Patent: Jun. 22, 2004

(54) CIRCUIT BREAKER FOR A DUAL-CIRCUIT

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 0 days.

(21) Appl. No.: 10/658,336

(22) Filed: Sep. 10, 2003

(51) Int. Cl.[7] ..... H01H 5/00
(52) U.S. Cl. ..... 200/400; 200/18; 200/339
(58) Field of Search ..... 200/400, 401, 200/18, 17 R, 339

(56) References Cited

U.S. PATENT DOCUMENTS 5,451,729 A * 9/1995 Onderka et al. ..... 200/18
5,597,991 A * 1/1997 Chen et al. ..... 200/50.02
5,895,898 A * 4/1999 Godesa ..... 200/50.32
6,069,328 A * 5/2000 Oravetz et al. ..... 200/50.33
6,175,089 B1 * 1/2001 Kang ..... 200/400
6,437,262 B1 * 8/2002 Gupta et al. ..... 200/50.19

* cited by examiner

*Primary Examiner*—Lincoln Donovan
*Assistant Examiner*—K. Lee
(74) *Attorney, Agent, or Firm*—Fei-Fei Chao; Venable LLP

(57) ABSTRACT

A circuit breaker for a dual-circuit includes a body with two chambers. Two pairs of terminals are respectively provided in the two chambers and extend out from the body. The first terminal has a first immovable node, and the second terminal has a bimetallic strip and a first movable node on the bimetallic strip and electrically connected with the first immovable node. The third terminal has a second immovable node, and the fourth terminal has a metal strip and a second movable node on the metal strip and electrically connected with the second immovable node. A linkage transversally extends between the metal strip and the bimetallic strip. A reset button is pivotally mounted in the body and has a tab formed at a bottom side thereof and located in the first chamber and near the first terminal. A hook installed on the tab is attached to the bimetallic strip.

2 Claims, 7 Drawing Sheets

CIRCUIT BREAKER FOR A DUAL-CIRCUIT

BACKGROUND OF THE INVENTION

1. Field of the Invention

The present invention is related to a circuit breaker to automatically terminate an electricity supply in an excessive-demand condition, and more particularly to a circuit breaker with four terminals used for a dual-circuit.

2. Description of Related Art

For protecting electrical equipment, a circuit breaker is generally used to terminate a supply of electricity when a device connected to the supply starts to draw an excessive amount of electricity.

A conventional circuit breaker is generally provided with two terminals. A bimetallic strip with a movable node is formed on one of the terminals. In a normal state, the movable node is electrically connected with an immovable node formed on the other terminal. In an excessive demand condition, the bimetallic strip becomes hot and deforms whereby the movable node is disconnected from the immovable node to switch off the circuit.

However, the conventional circuit breaker can only be used in a single-circuit closed by the two terminals, and cannot be used in a dual-circuit which needs four terminals to close it.

Therefore, the invention provides a circuit breaker for a dual-circuit to mitigate and/or obviate the aforementioned problems.

SUMMARY OF THE INVENTION

The main objective of the present invention is to provide a circuit breaker which has four terminals to terminate a dual-circuit in an excessive-demand condition.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
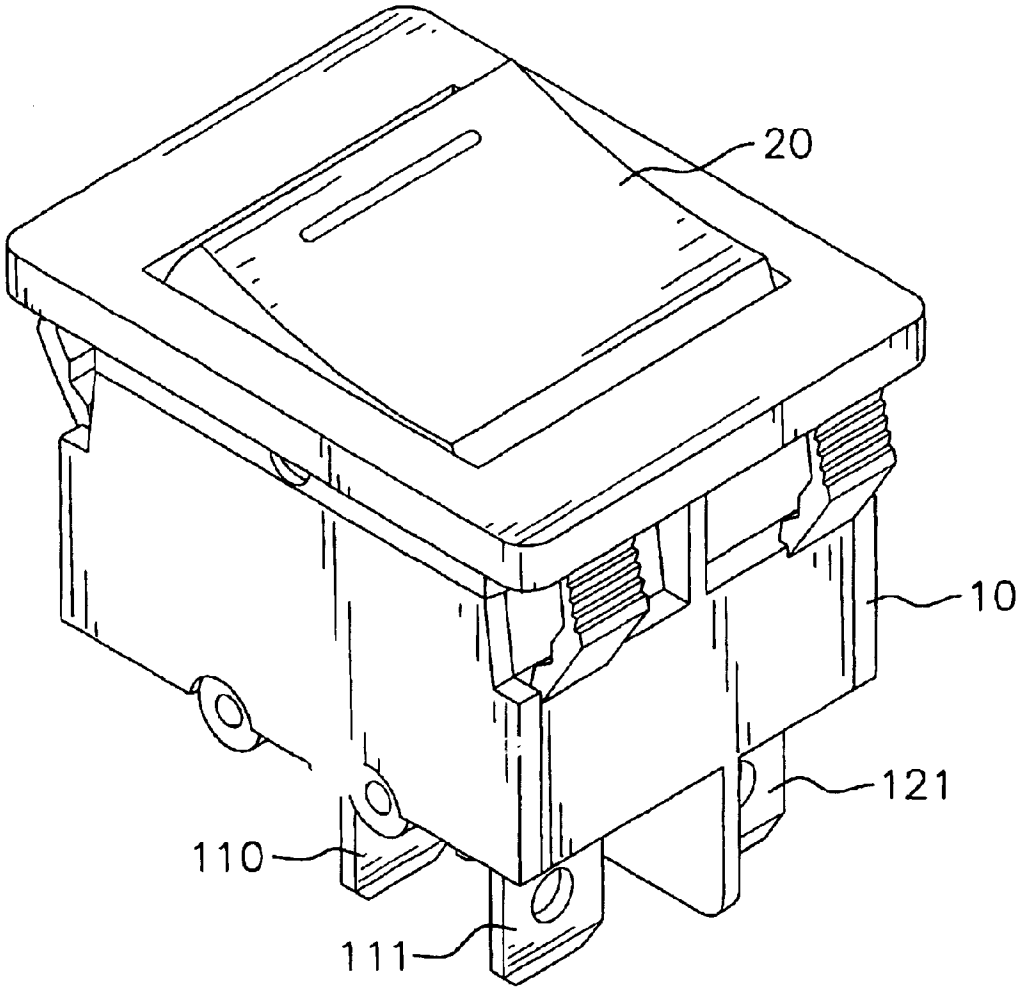
FIG. 1 is a perspective view of a circuit breaker with four terminals in accordance with the invention.
Figure 2:
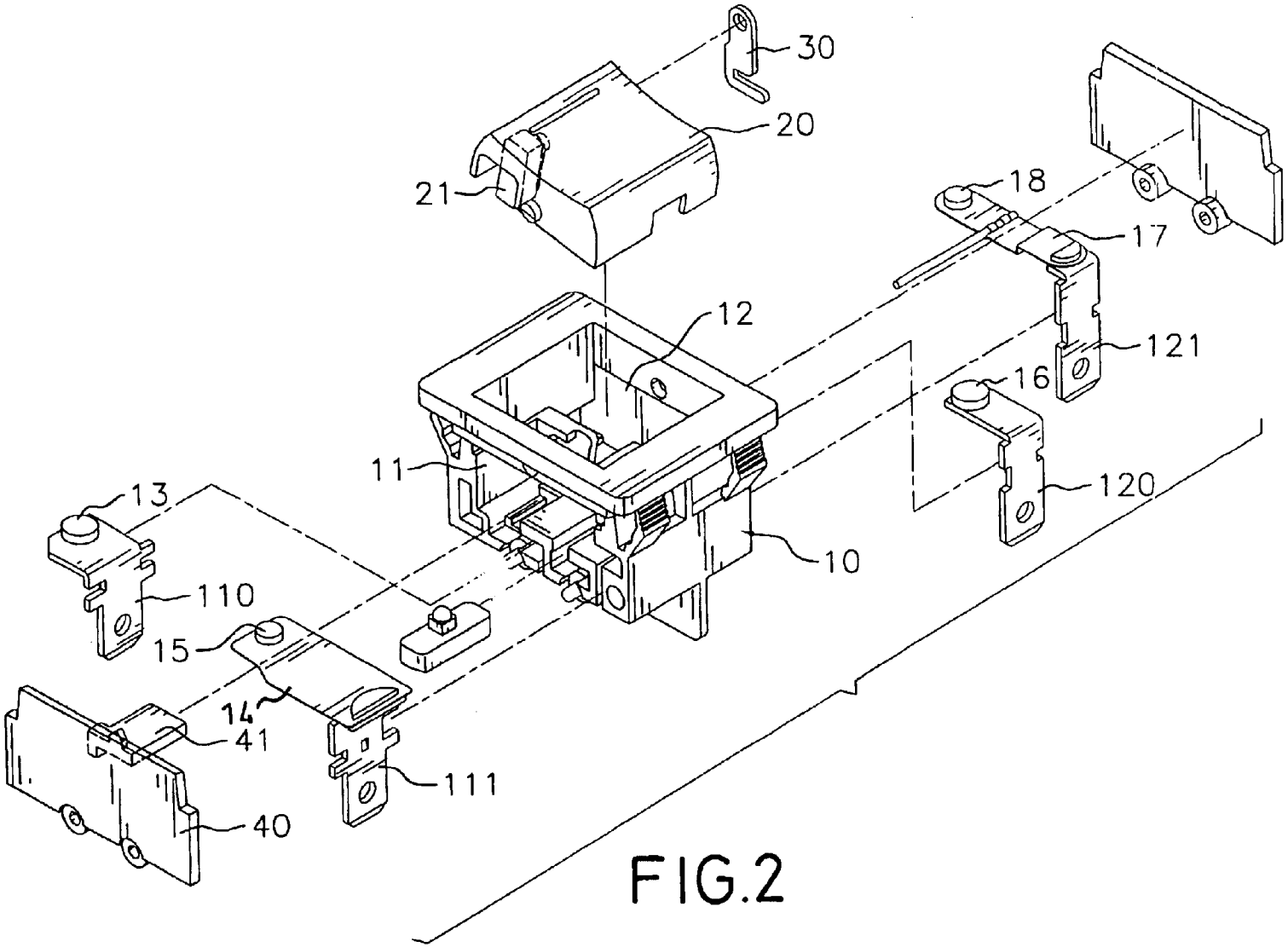
FIG. 2 is an exploded perspective view of the circuit breaker in FIG. 1.
Figure 3:
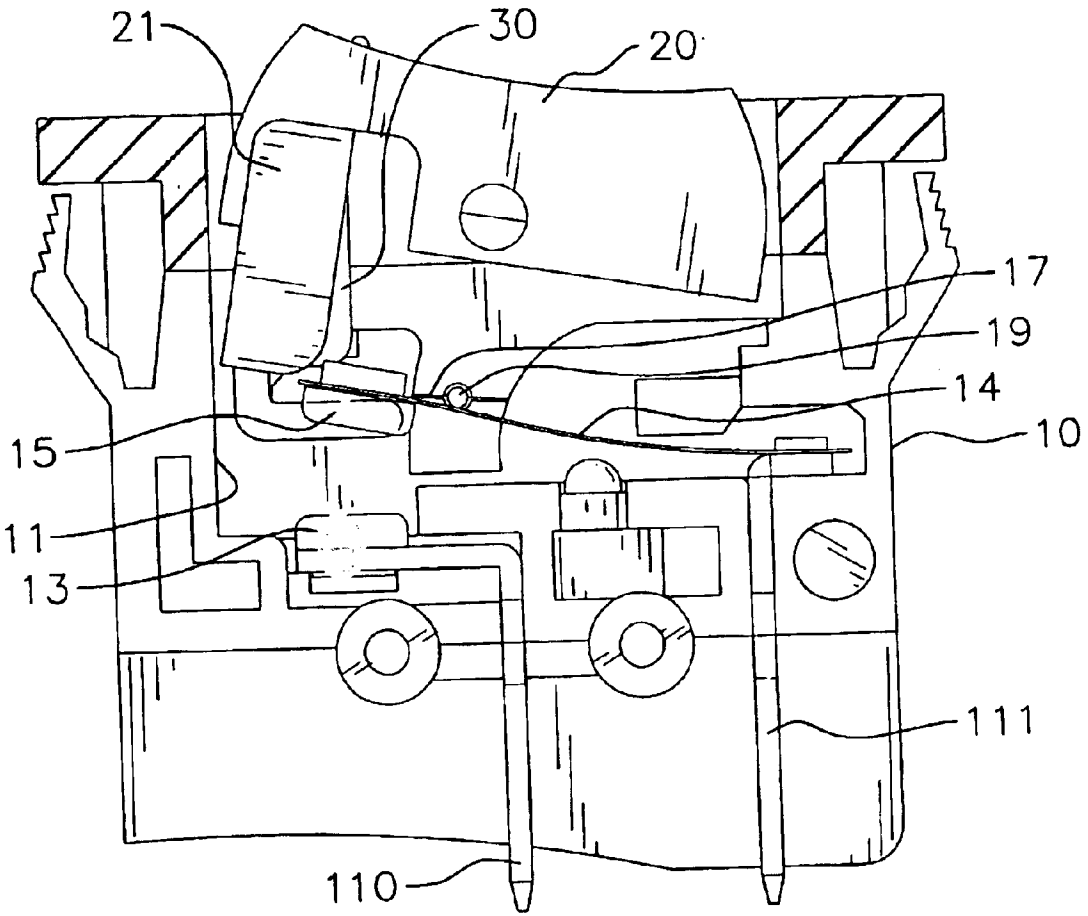
FIG. 3 is a cross sectional front view of the circuit breaker in a switched-off state.

With reference to FIGS. 1–3, a circuit breaker for a dual-circuit in accordance with the invention has a body (10) and two chambers (11, 12) separately defined in the body (10). The first chamber (11) has a first terminal (110) and a second terminal (111) mounted therein and extending out from a lower side of the body (10). The first terminal (110) has a first immovable node (13) formed at an upper end thereof, and the second terminal (111) has a bimetallic strip (14) extending above the first terminal (110). A first movable node (15) is formed at a distal end of the bimetallic strip (111) and aligned with the first immovable node (13). When the first movable node (15) is electrically connected with the first immovable node (13), the first circuit (primary circuit) of the dual-circuit is closed.

The second chamber (12) has a third terminal (120) and a fourth terminal (121) mounted therein and extending out from the lower side of the body (10). The third terminal (120) has a second immovable node (16) formed at an upper end thereof, and the fourth terminal (121) has a metal strip (17) extending above the third terminal (120). A second movable node (18) is formed at a distal end of the metal strip (17) and aligned with the second immovable node (16). A linkage (19) transversally extends between the metal strip (17) and the bimetallic strip (14) and has a first end (not numbered) mounted at a middle portion of the metal strip (17) and a second end (not numbered) abutting on the bimetallic strip (14). When the second movable node (18) is electrically connected with the second immovable node (16), the second circuit (secondary circuit) of the dual-circuit is closed.

Figure 5:
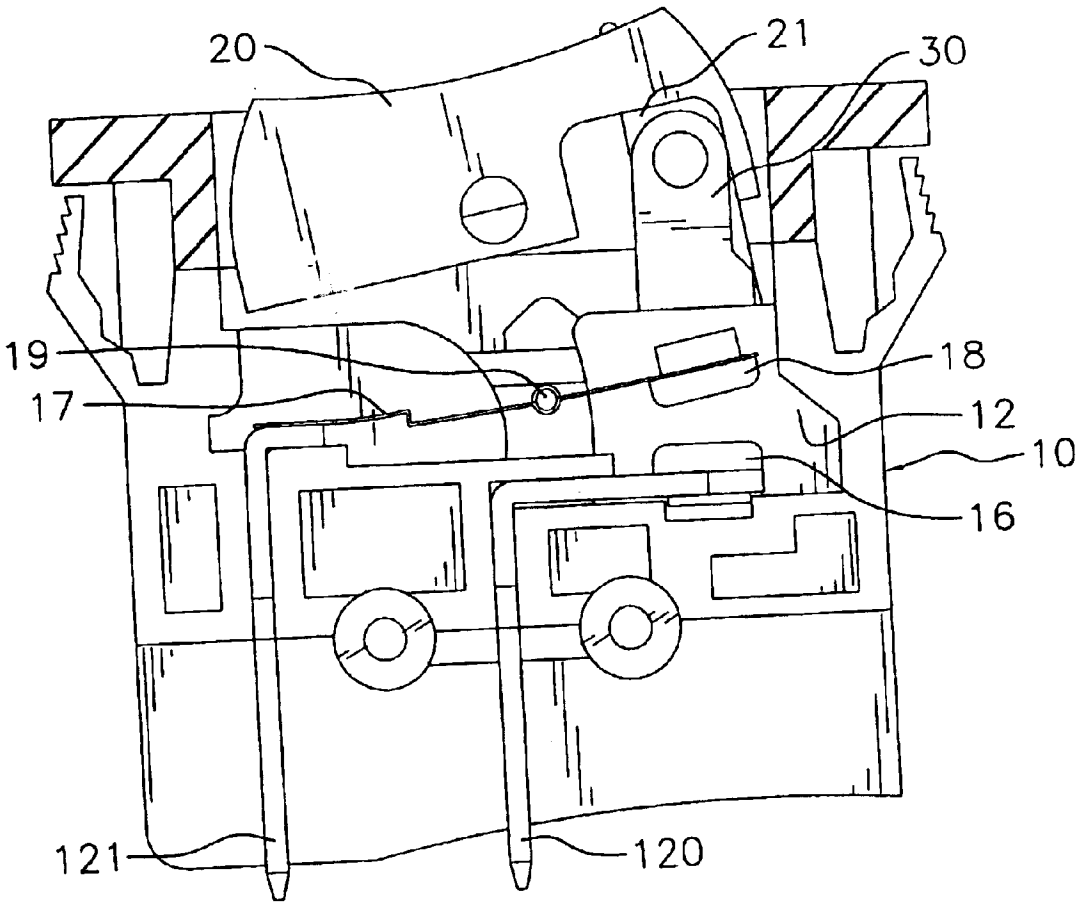
FIG. 5 is a cross sectional back view of FIG. 3.
Figure 6:
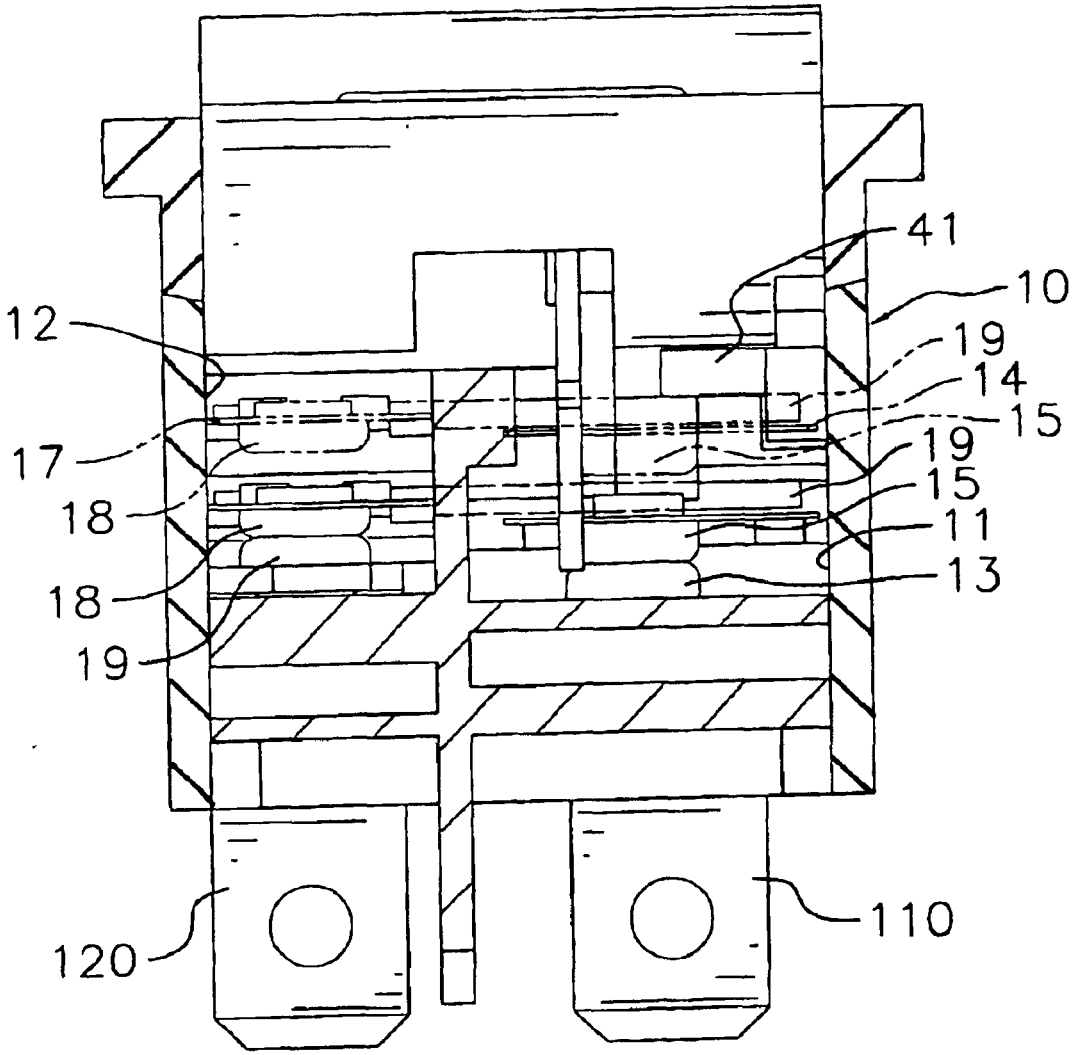
FIG. 6 is a cross sectional side view of the circuit breaker along the line "6—6" in FIG. 4.

A reset button (20) is pivotally mounted at an upper side of the body (10). A tab (21) is formed at a bottom side of the reset button (20) and located in the first chamber (11) and near the first movable node (15). A hook (30) installed on the tab (21) is attached to the distal end of the bimetallic strip (14), as shown in FIG. 3. When the reset button (20) is pressed to pull upwards the bimetallic strip (14) by the hook (30), the first movable node (15) is disconnected from the first immovable node (13). At the same time, the linkage (19) is pushed upward by the bimetallic strip (14) to disconnect the second movable node (18) from the second immovable node (16), as shown in FIGS. 5 and 6. In this case, the linkage (19) has a slight deformation with an elastic force.

Figure 4:
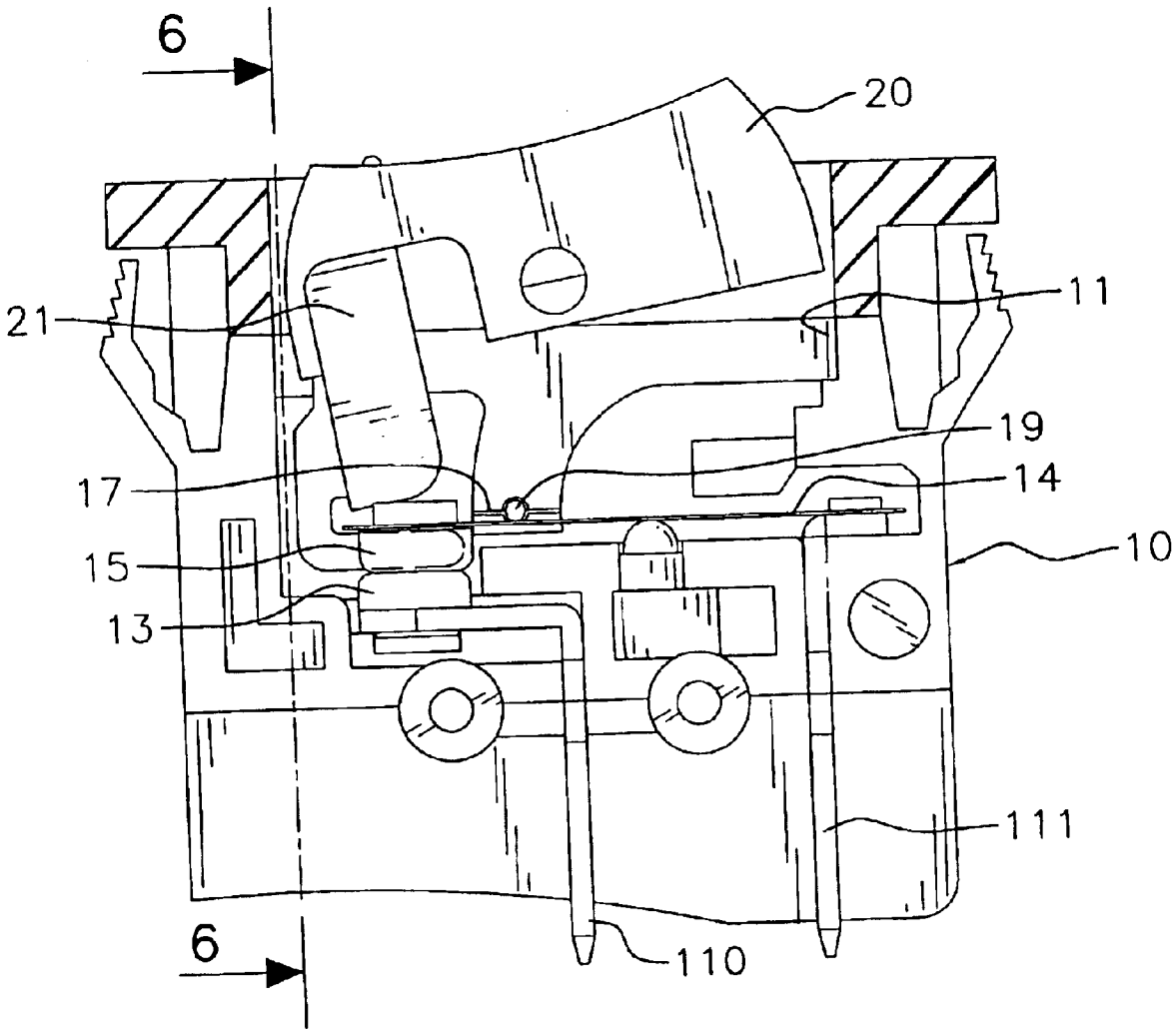
FIG. 4 is a cross sectional front view of the circuit breaker in a switched-on state.

With reference to FIG. 4, when the reset button (20) is pressed to close the dual-circuit, the tab (21) pushes the bimetallic strip (14) downwards to connect the first movable node (15) with the first immovable node (13). Under the elastic force of the linkage (19), the metal strip (17) is also moved downwards to connect the second movable node (18) with the second immovable node (16). Then, the dual-circuit is closed.

When the circuit undergoes an excessive-consumption of electricity, the bimetallic strip (14) becomes hot and deforms upwards to disconnect the first movable node (15) from the first immovable node (13), as shown in FIG. 3. At the same time, the linkage (19) is pushed upward by the bimetallic strip (14) to disconnect the second movable node (18) from the second immovable node (16), as shown in FIGS. 5 and 6. Then, the dual-circuit is terminated.

Figure 7:
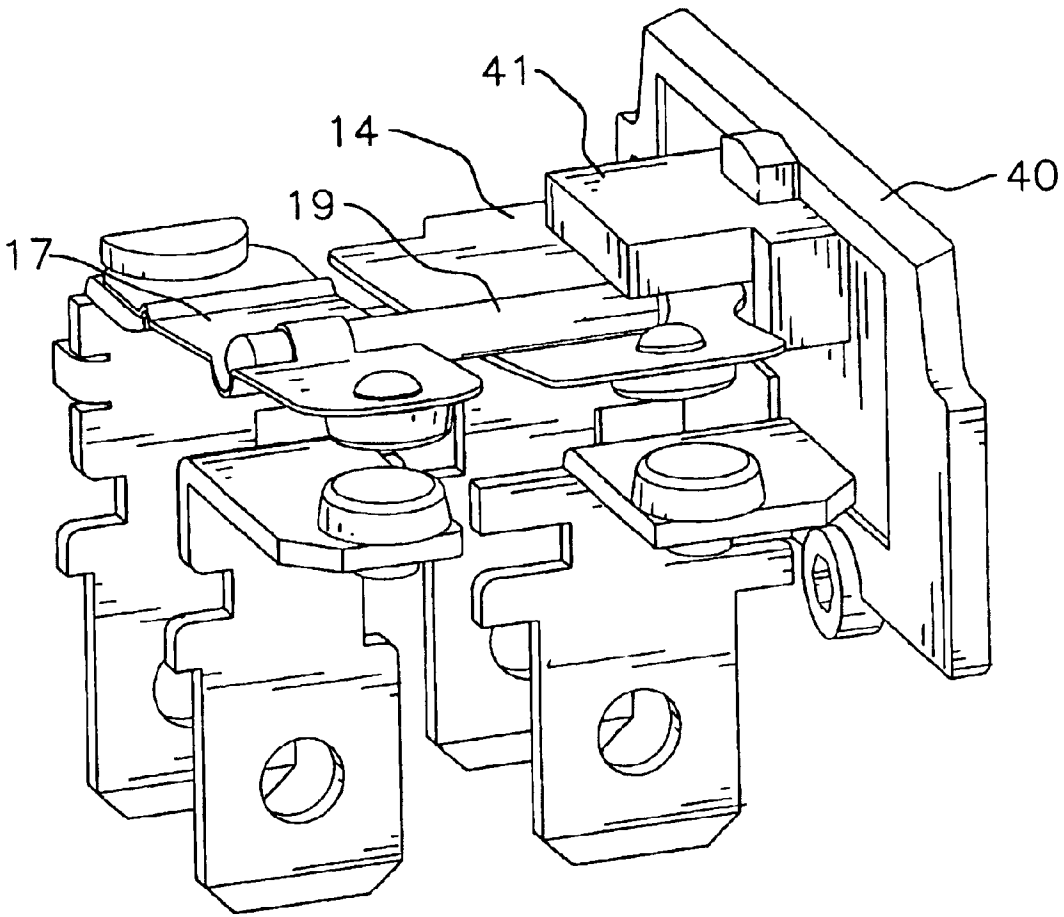
FIG. 7 is a partial perspective view of the circuit breaker.

Furthermore, with reference to FIGS. 2 and 7, if the bimetallic strip (14) deforms to excessively raise the second end of the linkage (17) abutting on the bimetallic strip (14), the first end of the linkage (17) on the metal strip (17) may be pressed down and the metal strip (17) cannot be pulled upward to terminate the second circuit. Therefore, a stop (41) is formed on a side wall (40) of the first chamber (11) and protruded above the bimetallic strip (14). After the bimetallic strip (14) deforms upwards to disconnect the first movable node (15) from the first immovable node (13), the second end of the linkage (17) abutting on the bimetallic strip (14) is blocked by the stop (41) and will not be excessively raised, and the first end of the linkage (17) can be moved upwards to disconnect the second movable node (18) from the second immovable node (16).

According to the present invention, the circuit breaker for the dual-circuit is provided with the bimetallic strip to terminate the primary circuit, and the metal strip connected by the linkage to terminate the secondary circuit. The cost of the metal strip is lower than the bimetallic strip, so the circuit breaker has a low cost and a high security.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A circuit breaker for a dual-circuit comprising:

a body having a first chamber and a second chamber separately defined in the body;

a first terminal and a second terminal mounted in the first chamber and extending out of from a lower side of the body, wherein the first terminal has a first immovable node formed on an upper end thereof, and the second terminal has a bimetallic strip extending above the first terminal and a first movable node formed at a distal end of the bimetallic strip and electrically connected with the first immovable node in a normal status that the circuit is completed and a device electrically connected in the circuit is switched on;

a third terminal and a fourth terminal mounted in the second chamber and extending out of from the lower side of the body, wherein the third terminal has a second immovable node formed on an upper end thereof, and the fourth terminal has a metal strip extending above the third terminal and a second movable node formed at a distal end of the metal strip and electrically connected with the second immovable node in the normal status;

a linkage transversally extending between the metal strip and the bimetallic strip and having a first end mounted at a middle portion of the metal strip and a second end abutting on the bimetallic strip;

a reset button pivotally mounted at an upper side of the body and having a tab formed at a bottom side of the reset button and located in the first chamber and near the first movable node; and a hook installed on the tab and attached to the distal end of the bimetallic strip.

2. The circuit breaker as claimed in claim 1 further comprising a stop formed on a side wall of the first chamber and protruded above the bimetallic strip.

* * * * *